US009576784B2

(12) United States Patent
Hechtfischer et al.

(10) Patent No.: US 9,576,784 B2
(45) Date of Patent: Feb. 21, 2017

(54) ELECTRICAL GAS-DISCHARGE LAMP WITH DISCHARGE-COUPLED ACTIVE ANTENNA

(71) Applicant: KONINKLIJKE PHILIPS N.V., Eindhoven (NL)

(72) Inventors: Ulrich Hechtfischer, Eindhoven (NL); Gennadi Tochadse, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 14/914,771

(22) PCT Filed: Aug. 29, 2014

(86) PCT No.: PCT/EP2014/068439

§ 371 (c)(1),
(2) Date: Feb. 26, 2016

(87) PCT Pub. No.: WO2015/028640

PCT Pub. Date: Mar. 5, 2015

(65) Prior Publication Data

US 2016/0211131 A1 Jul. 21, 2016

(30) Foreign Application Priority Data

Aug. 30, 2013 (EP) ..... 13182312

(51) Int. Cl.
*H01J 61/54* (2006.01)
*H01J 61/34* (2006.01)
(Continued)

(52) U.S. Cl.
CPC ..... *H01J 61/34* (2013.01); *F21S 48/1186* (2013.01); *H01J 61/0732* (2013.01); *H01J 61/54* (2013.01); *H01J 61/547* (2013.01)

(58) Field of Classification Search
CPC ..... H01J 61/34; H01J 61/0732; H01J 61/54; H01J 61/547; F21S 48/1186
See application file for complete search history.

(56) References Cited

U.S. PATENT DOCUMENTS

2011/0115371 A1* 5/2011 Steere ..... H01J 61/547 313/594
2012/0169224 A1 7/2012 Welter

FOREIGN PATENT DOCUMENTS

DE 202011103862 U1 10/2011
WO 2008007283 A2 1/2008
(Continued)

OTHER PUBLICATIONS

EPO as ISA, PCT/EP2014/068439, filed Aug. 29, 2014, "International Search Report and Written Opinion" dated Oct. 29, 2014, 11 pages.

(Continued)

*Primary Examiner* — Tracie Y Green

(57) ABSTRACT

The present invention relates to an electrical gas-discharge lamp comprising an inner bulb (1) arranged within an outer bulb (2), said inner bulb (1) being filled with a discharge gas and comprising a first electrode (3) and an opposing second electrode (4) having a distance from the first electrode (3) which allows ignition of a gas-discharge by applying an ignition voltage between the electrodes (3, 4). At least one through hole (11) is formed in the feedthrough to the electrically conductive lead (5) to the first electrode (3). An electrically conductive member (10) extents within a space formed between the inner (1) and the outer bulb (2) from a position close to the through hole (11) to a distance from the second electrode (4) which is smaller than the distance between the two electrodes (3,4). When applying the ignition voltage between the electrodes (3,4) an electrically conducting path (12) forms through the through hole (11)
(Continued)

between the electrically conductive member (10) and the electrically conductive lead (5) by ionization of the gas in the outer bulb (2). With this transient conductive path the coating (10) forms an active antenna effectively lowering the ignition voltage. The fabrication of the proposed lamp with reduced ignition voltage requires only few additional fabrication steps compared to a lamp without such an ignition aid.

11 Claims, 2 Drawing Sheets

(51) Int. Cl.
*F21S 8/10* (2006.01)
*H01J 61/073* (2006.01)

(56) References Cited

FOREIGN PATENT DOCUMENTS

| | | | |
|---|---|---|---|
| WO | 2008007284 | A2 | 1/2008 |
| WO | 2010041495 | A1 | 4/2010 |

OTHER PUBLICATIONS

Extended European Search Report mailed Jan. 27, 2014 from European Patent Application No. 13182312.2.

* cited by examiner

ELECTRICAL GAS-DISCHARGE LAMP WITH DISCHARGE-COUPLED ACTIVE ANTENNA

CROSS-REFERENCE TO RELATED APPLICATIONS

The present application is a §371 application of International Application No. PCT/EP2014/068439 filed on Aug. 29, 2014 and entitled "ELECTRICAL GAS-DISCHARGE LAMP WITH DISCHARGE-COUPLED ACTIVE ANTENNA," which claims priority to European Application No. 13182312.2, filed Aug. 30, 2013. PCT/EP2014/068439 and 13182312.2 are incorporated herein.

BACKGROUND OF THE INVENTION

The present invention relates to an electrical gas-discharge lamp comprising an inner bulb arranged within an outer bulb, said inner bulb being filled with a discharge gas and comprising a first electrode and an opposing second electrode having a distance from the first electrode which allows ignition of a gas-discharge in said inner bulb by applying an ignition voltage between the electrodes.

Such a construction allows the realization of high-intensity discharge (HID) lamps for automotive applications, in which the inner bulb is filled with the discharge gas at high pressure. This high pressure allows a high intensity of the light emitted by the lamp with only a small delay after ignition which is necessary in the automotive field. Due to the high pressure of the discharge gas in the inner bulb automotive HID lamps require notoriously high ignition voltages of the order of 20 kV in order to ensure sufficient luminous flux already after a few seconds of operation. This particularly applies to automotive HID lamps. The high ignition voltage however requires a complex, expensive ignition circuit.

DESCRIPTION OF PRIOR ART

There are several methods known to lower the ignition voltage of HID lamps and especially of automotive HID lamps, which can be considered as consisting of three basic measures. A first known measure is to generate a dielectric-barrier discharge (DBD) in the gas fill of the outer bulb that is formed temporarily during the fast ignition pulse and helps the main discharge in the inner bulb to ignite at a lower voltage. During the ignition a DBD forms between both electrode sides of the inner bulb during ignition of the lamp. The transient plasma of the DBD creates an electrical field that increases the field in the inner bulb and helps ignition. The formation of the DBD requires a correct adjustment of the pressure of the gas in the outer bulb.

A second measure is the use of a passive antenna which is formed by an electrically conductive member like a wire or an electrically conductive coating on the outside of the inner bulb. The term "passive" means that the antenna is at floating potential, i.e. not connected to any of the two electrically conducting leads for contacting the electrodes of the inner bulb. The coating is formed of an optically transparent material and capacitively coupled to the electrically conductive leads contacting the electrodes. During the fast ignition pulse, a supporting electrical field is generated by this passive antenna that increases the field strength in the inner bulb and helps ignition. It is also known to combine both measures by using a passive antenna in combination with a DBD.

WO2008/007284 A2 describes a method for lowering the ignition voltage of an HID lamp by generating a DBD in the gas fill of the outer bulb that is allowed to get in contact with one of the two electrically conductive leads to the electrodes of the inner bulb directly, rather than only capacitively. This is achieved by machining a small, thin through hole or channel into one of the feedthroughs of the electrically conductive leads within the outer bulb. The transient DBD can then couple via the through hole to the corresponding lead.

A third measure of lowering the ignition voltage of a HID lamp is to use an active antenna. The term "active" means that the antenna is directly (galvanically) connected to one of the electrically conductive leads which contact to the electrodes of the inner bulb. The use of such an active antenna is more effective than the above described first and second measures. One possibility for the realization of such an active antenna is to connect a wire to one of the leads which then extends close to the opposite electrode. In this way, a high electric field is created near this opposite electrode and the ignition voltage is lowered. The active antenna is connected outside of the outer bulb to the electrically conductive lead. However, such a construction is very difficult to build in practice because it requires many additional production steps, including an additional feedthrough for the outer bulb.

WO2008/007283 A2 discloses a HID lamp with an active antenna which is connected to one of the electrically conductive leads to the electrodes of the inner bulb inside of the outer bulb. To this end, a small through hole is formed in the feedthrough for the corresponding electrically conductive lead within the outer bulb. The active antenna is then formed by an electrically conductive coating which extends to the through hole and fills the through hole to directly (galvanically) contact the electrically conductive lead. This solution however requires additional effort for the electrical contacting during the production process.

U.S. 2012/0169224 A1 discloses a HID lamp with a ceramic discharge vessel having sealed first and second end plugs and an external electrical antenna. The end plug openings are sealed with sealing glass. The sealing glass is electrically conductive. The external electrical antenna extends over at least part of the external surface of the ceramic discharge vessel and over at least part of the external surface of one of the end plugs. The end plugs enclose current lead-through conductors. The antenna is not in physical contact with the current lead-through conductors; however, there is electrical contact through the electrically conductive sealing glass.

SUMMARY OF THE INVENTION

It is an object of the present invention to provide an electrical gas-discharge lamp of the above kind which comprises a reduced ignition voltage and can be fabricated in a simple manner.

The object is achieved with the electrical gas-discharge lamp according to claim 1. Advantageous embodiments of the lamp are subject matter of the dependent claims or are described in the subsequent portions of the description and preferred embodiments.

The proposed electrical gas-discharge lamp, in particular an automotive HID lamp, is formed of an inner bulb and an outer bulb, the inner bulb being arranged within the outer bulb, said inner bulb being filled with a discharge gas and comprising a first electrode and an opposing second electrode having a distance from the first electrode which allows ignition of a gas-discharge in the inner bulb by applying an ignition voltage between both electrodes. The inner and outer bulbs are made of an appropriate material which is optically transmissive for the desired radiation emitted by the discharge. Typically, the inner and outer bulb are made of a glass material, in particular quartz glass. In order to allow the inner bulb to be filled with a discharge gas of high pressure, the inner bulb together with the two electrodes is appropriately sealed gas-tight. The first electrode is electrically connected through a first electrically conductive lead extending in an electrically insulating feedthrough on a first side of the inner bulb through the outer bulb. In the same manner, the second electrode is electrically contacted by means of a second electrically conductive lead extending in a second electrically insulating feedthrough on a second side of the inner bulb through the outer bulb. These feedthroughs carrying the electrically conductive leads to contact the electrodes are preferably also made from the glass material of the inner bulb and may be formed in one single production step together with the inner bulb. Nevertheless, these feedthroughs, which e.g. have a tubular shape, may also be made from another material and gas-tightly connected to the inner bulb. The electrical conductive leads for contacting the electrodes of the inner bulb are guided via these feedthroughs to the outside of the outer bulb in order to enable to electrically contact the lamp for applying the required ignition voltage and operation currents. The outer bulb is filled with a second gas, preferably at a pressure lower than atmospheric pressure, in particular in the range between 10 and 500 hPa. Suitable filling gases for the outer bulb are for example xenon, krypton, argon and neon. The outer bulb may also be filled with other gases or gas mixtures, e.g. with air. The discharge gas of the inner bulb is an inert gas, for example a xenon gas. The inner bulb may also be filled with other inert gases or with mixtures of inert gases, metal halides, mercury if required, etc.

In the proposed electrical gas-discharge lamp at least one through hole or channel is formed in the first feedthrough to the first electrically conductive lead. An electrically conductive member extends within the space formed between the inner and the outer bulb at least from a position close to the through hole to a distance from the second electrode which is smaller than the distance between the two electrodes. The position of the electrically conductive member close to the through hole is such that an electrically conducting path temporary forms through the through hole between the electrically conductive member and the first electrically conductive lead by ionization of the second gas when applying said ignition voltage between the electrodes. It does not matter if the through hole—and thus the temporary electrically conductive path—is made to the lead to which the high voltage is applied or to the lead which is near ground potential during the ignition pulse.

With this construction of the electrical gas-discharge lamp, the electrically conductive member forms an active antenna only during the ignition of the lamp by being electrically contacted to the electrically conductive lead by the conductive path formed through ionization of the second gas. The feature that the position of the electrically conductive member is "close" to the through hole in this context means that the electrically conductive member must be positioned close enough to the through hole to achieve the desired electrical contacting via the ionized second gas. This position is thus dependent on the gas type and gas pressure of the second gas in the outer bulb and may be different with different pressures and gases.

The electrically conductive member may be a self-supporting element like a wire or an element applied to the outer surface of the inner bulb, e.g. an electrically conductive coating or partial coating. This electrically conductive member extends towards the second side of the inner bulb to have a distance to the second electrode which is smaller than the distance between the two electrodes within the inner bulb. Due to this smaller distance a higher electrical field is achieved in the vicinity of the second electrode during ignition resulting in a reduced ignition voltage compared to a construction without such an electrically conductive member. The reduction in ignition voltage scales with the distance between the electrically conductive member and the second electrode, i.e. a smaller distance results in a stronger reduction of the ignition voltage. Therefore, the electrically conductive member preferably extends over the whole inner bulb towards the second feedthrough.

The proposed electrical gas-discharge lamp allows a reduction in ignition voltage of an automotive HID lamp, and also of other lamp types, and may be fabricated in an easy manner since no direct electrical contact between the electrical conductive member forming the antenna and the electrical conductive lead has to be established during fabrication. The fabrication only requires the formation of the electrically conductive member in the space between the inner bulb and the outer bulb, e.g. by simply applying an electrically conductive coating or partial coating to the outside of the inner bulb, and the machining of a small through hole in the corresponding feedthrough. Contrary to the known solutions in the prior art the effect of the through hole is not to enhance a DBD in the outer bulb fill, but to allow a temporarily conductive connection of the originally passive antenna formed by the electrically conductive member to the corresponding lead, which makes the antenna temporarily active. Surprisingly, this has been found to lower the ignition voltage as strongly as a true active antenna directly connected to the lead. The outer bulb gas-fill, i.e. the second gas, preferably should have a pressure significantly below atmospheric pressure, i.e. 10-500 hPa, just as for a normal DBD. However, the performance of the through hole discharge does not depend as critically on pressure as the volume DBD of the prior art measures. In other words, almost any gas-fill at any low pressure will do.

The electrically conductive leads of the proposed electrical discharge-gas lamp preferably comprise at least one section formed of a metal foil, in particular a molybdenum foil, as known in the art. The through hole is then preferably made towards the metal foil to expose a small portion of this foil, since a hole to the metal foil does not affect the gas-tight sealing of the inner bulb or of the outer bulb which might be the case when machining the hole to the electrode or to another portion of the lead.

In a preferred embodiment, the electrically conductive member forming the antenna is an optically transparent coating or partial coating of the outer side of the inner bulb. An exemplary material for such an electrically conductive and optically transparent coating is a doped tin oxide, for example a tin oxide doped with boron and/or lithium. Using such an optically transparent coating has the advantage that the whole inner bulb may be dipped in a corresponding coating solution during fabrication and thus totally coated with this coating material. This allows a very simple production of the electrically conductive member.

In a further embodiment, the electrically conductive member may be formed of a partial coating of a non-transparent electrically conductive material. In this case, the outer surface of the inner bulb is only partially coated with this material in order to avoid a significant shading of the light emission. The antenna in this case may for example be formed of a stripe-shaped metallic coating. Nevertheless, also other electrically conductive materials can be used. The coating can be applied by known coating processes, e.g. by painting, sputtering or chemical vapor deposition. In case of a ceramic bulb, the electrically conductive material forming the antenna may also be applied to the unsintered material of the bulb and sintered together with the bulb. In any case, the antenna must be formed such as to absorb as little light as possible and to withstand the high temperature of the inner bulb during operation of the lamp.

The thickness of the coating forming the electrically conductive member of the proposed discharge lamp is preferably between 50 and 200 nm. Depending on the electrical conductivity of the applied material, also other thicknesses are possible. The electrical resistance value of the applied electrically conductive member is preferably lower than 100 kΩ. This resistance value can be achieved by the combination of the applied material and the thickness of the coating. However, the invention is not limited to such a resistance value.

The proposed gas-discharge lamp is preferably used as an HID lamp since the effect of lowering the ignition voltage is mostly desired in these types of lamps. The proposed lamp may be used for example as an automotive HID lamp, especially the so called D5 lamp, but also for other types of gas-discharge lamps, e.g. lamps for projection systems.

BRIEF DESCRIPTION OF THE DRAWINGS

The proposed electrical gas-discharge lamp is described in the following by way of examples in connection with the accompanying figures. The figures show.

DETAILED DESCRIPTION OF EMBODIMENTS

Figure 1:
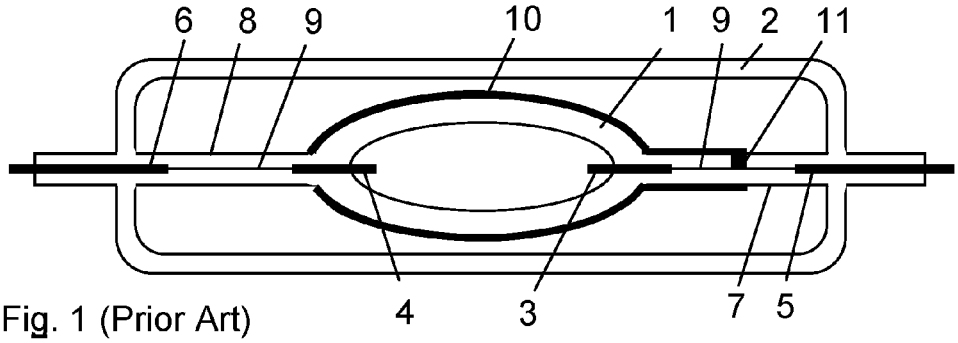
Fig. 1 (Prior Art)
FIG. 1 a schematic cross-sectional view of a HID lamp of the prior art.

FIG. 1 shows a schematic side view of an exemplary embodiment of a HID lamp of the prior art, as known e.g. from WO2008/007283 A2. The discharge lamp is formed of an inner bulb 1 arranged within an outer bulb 2. Both bulbs are made of a quartz glass material optically transparent in the visible wavelength region. The inner bulb 1 comprises two electrodes 3, 4 which are arranged at a distance from one another to allow ignition of a gas-discharge by applying an ignition voltage between the electrodes 3, 4. The inner bulb 1 together with the electrodes 3, 4 and the outer bulb 2 are gas-tightly sealed. The electrodes 3, 4 are electrically contacted by corresponding electrically conductive leads 5, 6 which extend through appropriate feedthroughs 7, 8 to the outside of the outer bulb 2. The electrically conductive leads 5, 6 comprise a section formed of a molybdenum foil 9 as known in the art. The inner bulb 1 is filled with a high-pressure inert discharge gas and with metal halides, the outer bulb 2 with a second gas. In order to lower the ignition voltage, an active antenna is arranged in the space between the inner bulb 1 and the outer bulb 2. The antenna is formed of an electrically conductive, optically transparent coating 10 on the outer surface of the inner bulb 1 and extends from the first feedthrough 7 to the second feedthrough 8 as indicated in the figure. A through hole 11 is formed in the first feedthrough 7 to the molybdenum foil 9 of the electrically conductive lead 5. This through hole 11 is filled with the electrically conductive material of the coating 10 to achieve a direct electrical connection between the coating 10 and the lead 5, thus forming an active antenna for lowering the ignition voltage of the lamp.

Figure 2:
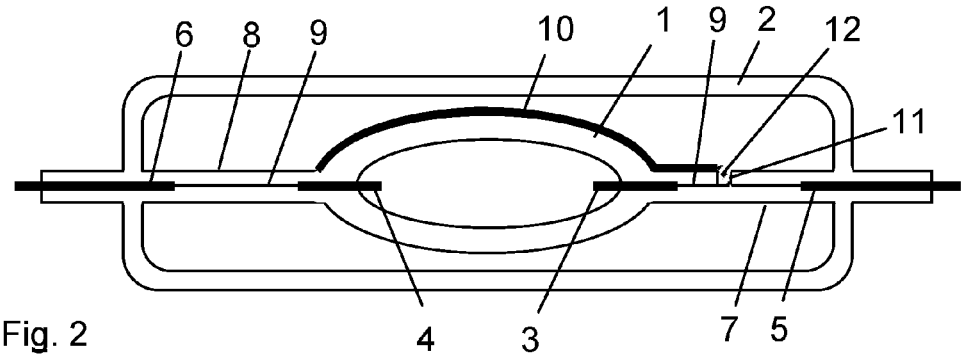
FIG. 2 a schematic cross-sectional view of an exemplary embodiment of the proposed gas-discharge lamp.

FIG. 2 shows a cross-sectional view of an exemplary first embodiment of the proposed gas-discharge lamp. The proposed gas-discharge lamp has a similar construction as that of FIG. 1. Therefore, the corresponding identical elements, i.e. bulbs, electrodes, leads and feedthroughs, are not newly described. In contrast to the lamp of FIG. 1, the through hole 11 in the proposed lamp is not filled with a coating but filled with the second gas of the outer bulb. In this embodiment, the antenna is formed of only a partial electrically conductive coating 10 which forms a stripe on the outer surface of the inner bulb 1 and extends from the through hole 11 to the second feedthrough 8 of the lamp. Therefore, prior to ignition of the lamp, the electrically conductive coating 10 is not electrically connected to the electrical conductive lead 5 of the lamp but forms only a passive antenna. When applying the ignition pulse to the lamp, an electrical connection between the coating 10 and the molybdenum foil 9 of the first electrically conductive lead 5 is temporarily generated by ionization of the second gas, i.e. by generation of a small discharge 12 in the through hole 11. This discharge 12 is only schematically indicated in FIG. 2. With his transient electrical connection, the originally passive antenna behaves like an active antenna and effectively lowers the ignition voltage of the lamp.

The through hole 11 may be formed by laser machining as is already known in the art of such lamps and has only a small diameter of e.g. 100 μm. As can be seen from FIG. 2, the distance between the electrically conductive coating 10 forming the antenna and the second electrode 4 is lower than the distance between the two electrodes 3, 4.

Figure 3:
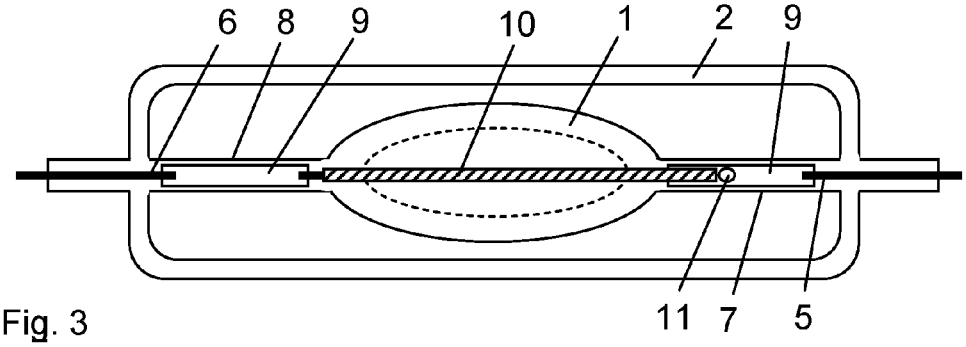
FIG. 3 a schematic view on the gas-discharge lamp of FIG. 2 perpendicular to the view of FIG. 2.

FIG. 3 shows a view onto the lamp of FIG. 2 perpendicular to the side view of FIG. 2. In this figure, the exemplary geometrical form of the antenna coating 10, i.e. the stripe-shaped form, can be recognized. This figure also shows the molybdenum foils 9 from another view.

Figure 4:
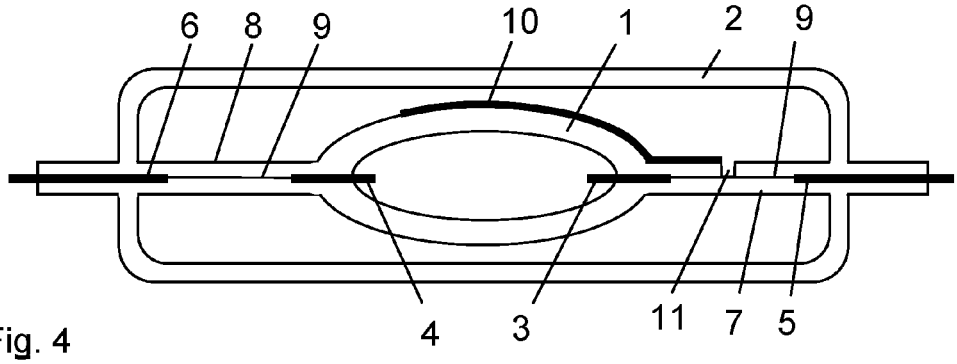
FIG. 4 a schematic cross-sectional view of a further embodiment of the proposed gas-discharge lamp.

The coating 10 forming the antenna must not in any case extend until the second electrode 4 or second feedthrough 8. Such an embodiment is schematically shown in the cross-sectional view of FIG. 4. Since the antenna in this embodiment has a higher distance to the second electrode 4, the ignition voltage is only lowered to a smaller degree than in the case of FIGS. 2 and 3. Nevertheless, the ignition voltage is still lowered compared to a construction without such an antenna.

Figure 5:
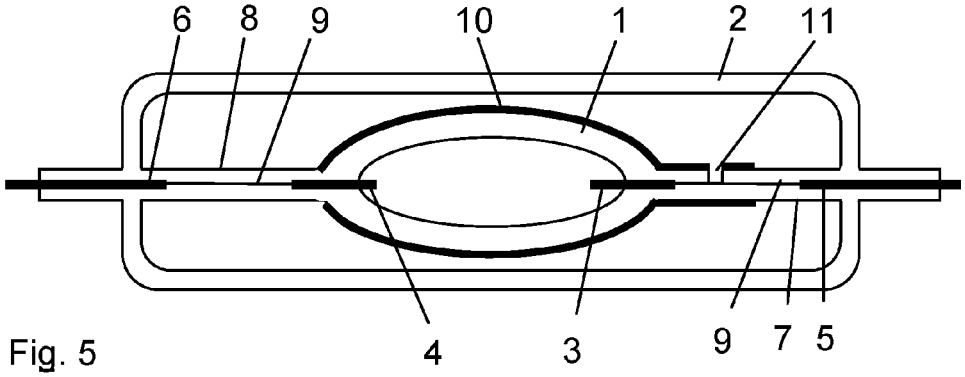
FIG. 5 a schematic cross-sectional view of a further embodiment of the proposed gas-discharge lamp.

FIG. 5 shows an embodiment of the proposed discharge lamp, in which the inner bulb 1 is completely coated with an optically transparent, conductive coating 10 forming the antenna of the discharge-lamp. Such a complete coating 10 can be applied in a very simple manner by only dipping the inner bulb 1 into a corresponding coating solution during fabrication.

Figure 6:
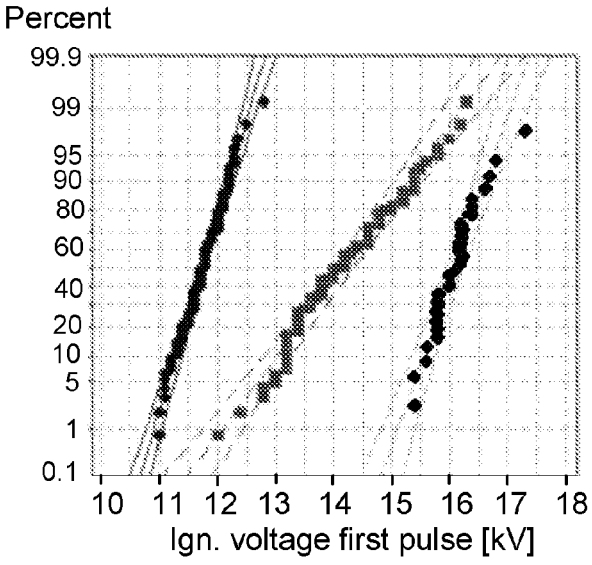
FIG. 6 a measurement diagram showing the reduction of the ignition voltage achieved with the proposed gas-discharge lamp.

A lamp as shown in FIGS. 2 and 3 has been fabricated by printing an antenna stripe with a width of about 1 mm with a high temperature-resistant, electrically conductive paint on the outer surface of the inner bulb 1. The lowering of the ignition voltage was measured with such a lamp. The lowering of the ignition voltage is shown in comparison with reference lamps in the probability plots of FIG. 6. For the reference lamps, 25 W lamps from D5 production with DBD and small passive antenna, the ignition voltages vary between 15 and 17.5 kV. If a through hole is added to enhance the DBD, the variation is between 12 kV and 16.5 kV. That is, there is a clear reduction of the mean, but unfortunately not as much of the maximum ignition voltage by this measure. When using a HID lamp according to FIGS. 2 and 3, the ignition voltage is only between 11 kV and 13 kV, which is a dramatic improvement compared with the reference lamps.

While the invention has been illustrated and described in detail in the drawings and forgoing description, such illustration and description are to be considered illustrative or exemplary and not restrictive. The invention is not limited to the disclosed embodiments. Other variations to the disclosed embodiments can be understood and effected by those skilled in the art in practicing the claimed invention, from a study of the drawings, the disclosure, and the appended claims. In the claims the word "comprising" does not exclude other elements or steps, and the indefinite article "a" or "an" does not exclude a plurality. The terms "first" and "second" in the claims and description are only used to differentiate the corresponding elements from one another and can also be interchanged. The mere fact that certain measures are recited in mutually different dependent claims does not indicate that a combination of these measures cannot be used to advantage. The features of claims 1 to 8 can be freely combined which each other. Any reference signs in the claims should not be construed as limiting the scope of the invention.

LIST OF REFERENCE SIGNS

1 inner bulb
2 outer bulb
3 first electrode
4 second electrode
5 first electrically conductive lead
6 second electrically conductive lead
7 first feedthrough
8 second feedthrough
9 molybdenum foil
10 electrically conductive coating
11 through hole
12 discharge

The invention claimed is:

1. An electrical gas-discharge lamp comprising:

an inner bulb and an outer bulb, the inner bulb being arranged within the outer bulb, said inner bulb being filled with a discharge gas and comprising a first electrode and an opposing second electrode having a distance from the first electrode which allows ignition of a gas discharge in the inner bulb by applying an ignition voltage between the electrodes, said first electrode being electrically contacted by a first electrically conductive lead, which extends in a first electrically insulating feedthrough on a first side of the inner bulb through the outer bulb, said second electrode being electrically contacted by a second electrically conductive lead extending in a second electrically insulating feedthrough on a second side of the inner bulb through the outer bulb, and said outer bulb being filled with a second gas, at least one through hole is formed in the first feedthrough to the first electrically conductive lead and an electrically conductive member extends within a space formed between the inner and the outer bulb at least from a position close to the through hole to a distance from the second electrode which is smaller than the distance between the two electrodes, said position of the electrically conductive member close to the through hole being such that, prior to ignition of the lamp, the electrically conductive member is not electrically connected to said first electrically conductive lead, and such that an electrically conducting path forms through the through hole between the electrically conductive member and the first electrically conductive lead by ionization of the second gas when applying said ignition voltage between the electrodes.

2. The electrical gas-discharge lamp according to claim 1, wherein at least the first electrically conductive lead comprises a section being formed of a metal foil, wherein said through hole extends to the metal foil.

3. The electrical gas-discharge lamp according to claim 1, wherein the electrically conductive member extends from the position close to the through hole to the second feedthrough.

4. The electrical gas-discharge lamp according to claim 1, wherein the electrically conductive member is formed of a coating or partial coating on the inner bulb.

5. The electrical gas-discharge lamp according to claim 1, wherein the electrically conductive member is formed of a stripe-shaped coating on the inner bulb.

6. The electrical gas-discharge lamp according to claim 1, wherein the electrically conductive member is formed of a material which is optically transparent in the visible wavelength range.

7. The electrical gas-discharge lamp according to claim 1, wherein the inner bulb contains metal halides in addition to the discharge gas.

8. The electrical gas-discharge lamp according to claim 1, wherein the pressure of the second gas in the outer bulb is lower than atmospheric pressure.

9. The electrical gas-discharge lamp according to claim 1, wherein the inner bulb is formed of quartz glass.

10. The electrical gas-discharge lamp according to claim 1, wherein the pressure of the discharge gas in the inner bulb is selected to form a high-pressure discharge lamp.

11. The electrical gas-discharge lamp according to claim 1, designed to be used as an automotive HID lamp.

* * * * *